United States Patent [19]

Yuhara

[11] Patent Number: 5,054,505

[45] Date of Patent: Oct. 8, 1991

[54] FACIAL COMPACT HAVING A STORAGE SPACE

[75] Inventor: Yukitomo Yuhara, Abiko, Japan

[73] Assignee: Yoshida Industry Co., Ltd., Tokyo, Japan

[21] Appl. No.: 541,495

[22] Filed: Jun. 20, 1990

[30] Foreign Application Priority Data

May 8, 1990 [JP] Japan ..... 2-47408[U]
May 10, 1990 [JP] Japan ..... 2-48097[U]

[51] Int. Cl.[5] ..... A45D 33/24; A45D 33/26; A45D 42/02; B65D 85/08

[52] U.S. Cl. ..... 132/294; 132/301; 132/304; 206/69

[58] Field of Search ..... 132/287, 293, 294, 295, 132/296, 301, 304; 206/581, 823, 69, 37, 38

[56] References Cited

U.S. PATENT DOCUMENTS

| | | | |
|---|---|---|---|
| 1,601,991 | 5/1923 | Albert | 132/295 |
| 1,650,712 | 9/1922 | Heiter | 132/294 |
| 4,276,893 | 7/1981 | Enomoto et al. | 132/83 R |
| 4,331,168 | 5/1982 | Hatakeyama | 132/79 G |
| 4,366,829 | 1/1983 | Yuhara | 132/83 R |
| 4,399,826 | 8/1983 | Ogasawara | 132/83 R |
| 4,474,196 | 10/1984 | Yuhara | 132/83 R |
| 4,483,355 | 11/1984 | Yuhara | 132/83 R |
| 4,595,028 | 6/1986 | Yuhara | 132/79 R |
| 4,679,576 | 7/1987 | Yuhara et al. | 132/83 R |
| 4,683,899 | 8/1987 | Yuhara et al. | 132/82 R |
| 4,696,317 | 9/1987 | Shioi et al. | 132/314 |
| 4,781,288 | 11/1988 | Wing | 206/37 |
| 4,898,195 | 2/1990 | Sussman | 132/317 |

*Primary Examiner*—John J. Wilson
*Assistant Examiner*—Cindy A. Cherichetti
*Attorney, Agent, or Firm*—Wenderoth, Lind & Ponack

[57] ABSTRACT

A facial compact has a storage space which can carry not only cosmetics but also cosmetic related articles or unrelated articles. The facial compact includes a receptacle member having space for accommodating cosmetic material, a cover member connected to the receptacle member at respective rear ends thereof, a recess formed in a lower surface of the cover member and defining therein a storage space, and a plate member movably provided at a lower portion of the cover member and capable of covering the storage space. The cosmetic related articles or the unrelated articles are stored in the storage space by closing the plate member in such a way such that the articles are not visible and may be removed from the storage space by opening the plate member.

8 Claims, 6 Drawing Sheets

FACIAL COMPACT HAVING A STORAGE SPACE

BACKGROUND OF THE INVENTION

The present invention relates to a facial compact for carrying cosmetics, and more particularly to a facial compact having a storage space which can carry not only cosmetics but also cosmetic related articles or unrelated articles.

In general, a facial compact basically comprises a receptacle member for accommodating therein cosmetics, and a cover member having a lower surface to which a mirror is attached, the receptacle member and the cover member being rotatably connected with each other at respective rear ends so that the cover member can be opened or closed relative to the receptacle member.

In order to maintain the cover member in a closed position relative to the receptacle member, the cover member has a projection extending downwardly from a front end of a lower surface thereof and a second engaging projection projecting rearwardly from the projection, the receptacle member has formed on a front end face thereof a first engaging projection which is engageable with the second engaging projection. The cover member is maintained in a closed position relative to the receptacle member by snap engagement between the first and second engaging projections. When opening the cover member from the closed state, the front end of the cover member is urged upwardly, and such upward displacement causes the second engaging projection of the cover member to climb over the first engaging projection of the receptacle member, so that the second engaging projection is disengaged from the first engaging projection and the cover member is opened relative to the receptacle member.

Currently, in order to improve the operation of opening the cover member, there has been proposed a facial compact which is disclosed, for example, in Laid-Open Utility Model Publication No. 62-33705. In such facial compact, the receptacle member is provided, at a front end face thereof, with a push piece which is retractable relative to the receptacle member. When pushing the push piece inwardly, an end portion of the push piece urges the projection of the cover member upwardly, thereby disengaging the snap engagement between the first and second engaging projections and opening the cover member relative to the receptacle member.

However, the foregoing conventional facial compact has the following problems.

(1) The push piece attached to the facial compact is very small and specifically is as small as or slightly larger than the projection. Therefore, it is difficult to push the push piece and the opening operation cannot be greatly improved.

(2) The receptacle member has, at a predetermined position of the front end face thereof, a small recess corresponding to the size of the push piece, and the push piece is provided in such recess. Therefore, it is troublesome to assemble the push piece in the recess.

(3) Besides the main function of covering the receptacle member, the cover member has only the additional function of supporting a mirror, and therefore space defined inside the cover member cannot be effectively utilized.

Next, further problems in connection with the above problem (3) will be described below in detail.

There are some women who cannot have a baby because of various reasons such as family finances, cultural ideas or family planning. Such women are required to practice birth control. In Japan, a condom is popular method of birth control. Usually, men carry condoms, and it is not the custom for women to carry condoms. If other people see a woman carrying a condom, they will be prejudiced against her.

However, once a woman becomes pregnant, there is tendency for the woman to incur both mental and physical injuries. Therefore, in order to avoid these injuries, it is desirable that a woman be able to carry condoms and practice birth control without having to depend on a man. Some condoms currently are sold in such a way that they are packaged in a fancy decorated case, such that other people would be able to see that a woman is carrying condoms. As a result, it has not been popular for women to carry condoms.

Further, in order to protect herself from venereal diseases such as AIDS or other sexually transmitted diseases, it is very important for a woman herself to carry condoms.

SUMMARY OF THE INVENTION

It is therefore an object of the present invention to provide a facial compact having a storage space in which the operation of opening the cover member of the compact can be greatly improved and space defined inside the cover member can be effectively utilized.

Another object of the present invention is to provide a facial compact having a storage space in which a contraceptive such as a condom or the pill can be secretly and reliably carried without others knowing of its contents.

According to one aspect of the present invention, there is provided a facial compact having a storage space and comprising: a receptacle member having space for accommodating cosmetic material; a cover member connected to the receptacle member at respective rear ends thereof in such a manner that the cover member is opened or closed relative to the receptacle member; a recess formed in a lower surface of the cover member and defining therein a storage space; a plate member slidably provided on a lower portion of the cover member and being capable of covering the storage space; first engaging means provided on the receptacle member; and second engaging means provided on the plate member and being engageable with the first engaging means, wherein the second engaging means is disengaged from the first engaging means so as to open the cover member by pushing the plate member toward the inside of the cover member, and wherein the storage space may be opened by withdrawing the plate member from the cover member.

With the above structure, when opening the cover member from a closed state, the plate member is pushed toward the inside of the cover member, such that the second engaging means is disengaged from the first engaging means, and the cover member is opened. The plate member thus corresponds to a conventional push piece but can be relatively large, thereby improving the operation of opening the cover member. On the other hand, the storage space may be opened by withdrawing the plate member from the cover member. Then, cosmetic related articles easily can be removed from the storage space. Further, since the plate member functions both as means for opening the cover member and means for covering the storage space, the overall thickness of the facial compact does not become excessive in spite of the provision of the storage space.

According to another aspect of the present invention, there is provided a facial compact having a storage space and comprising: a receptacle member having space for accommodating cosmetic material; a cover member connected to the receptacle member at respective rear ends thereof in such a manner that the cover member may be opened or closed relative to the receptacle member; a recess formed in a lower surface of the cover member and defining therein a storage space; and a plate member movably provided at a lower portion of the cover member and being capable of covering the storage space.

With the above structure, the storage space defined inside the cover member is normally covered by the plate member. Therefore, contraceptives may be accommodated in the storage space without being visible during normal use of the facial compact. Accordingly, when makeup is being applied, the facial compact can be used as a normal facial compact by opening the cover member, and when the contraceptive is to be used, the contraceptive accommodated in the storage space can be removed by drawing out the plate member and thus opening the storage space.

In the conventional facial compact, since the cover member has only the additional function of supporting a mirror, one would not think that contraceptives are accommodated inside the cover member. In other words, the advantage of the facial compact according to the present invention is that because it looks like a conventional facial compact, one would not think, by looking at the new facial compact, that contraceptives are stored therein. Therefore, contraceptives such as a condoms or pills can be secretly and reliably carried without others knowledge.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE INVENTION

Figure 1:
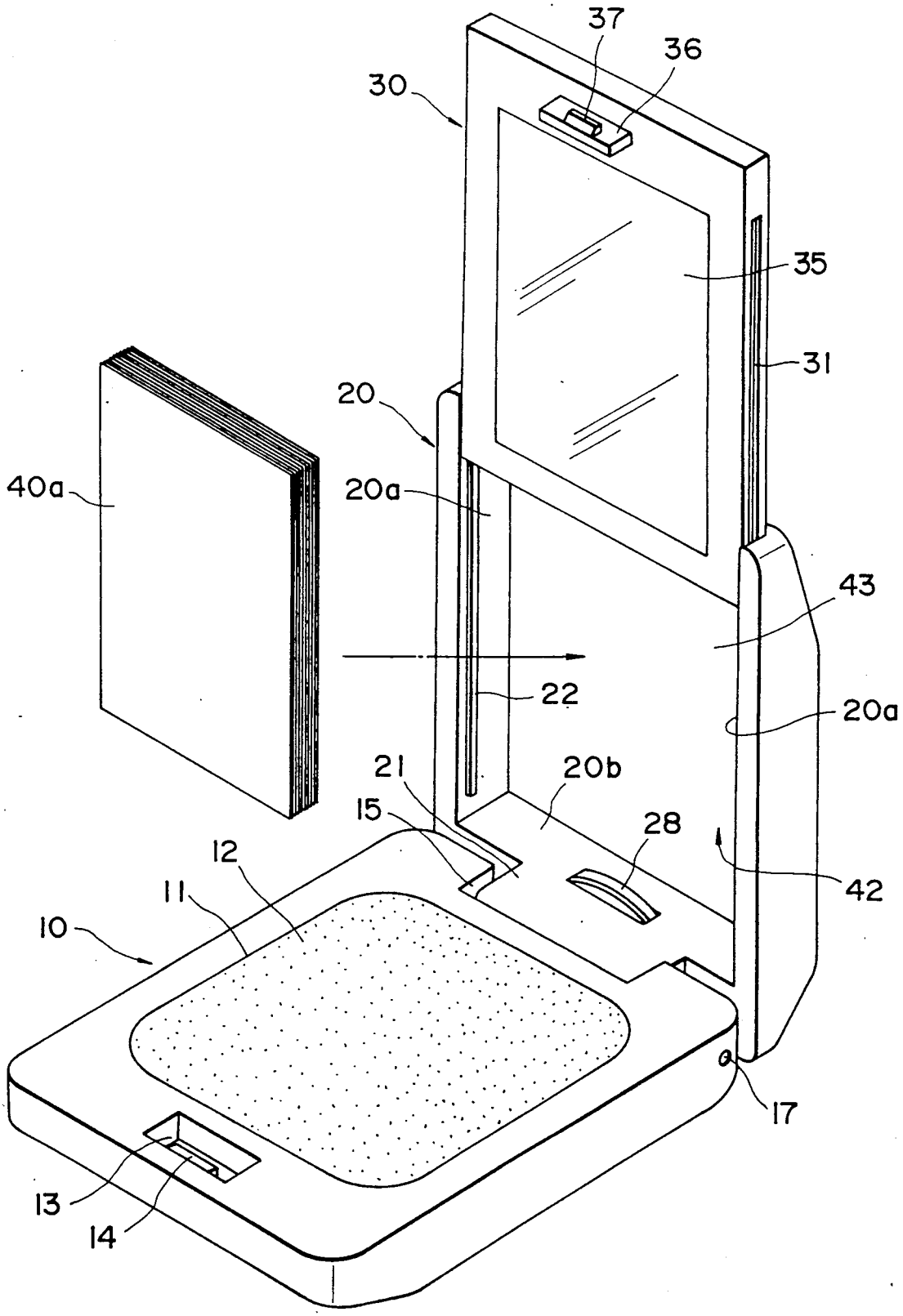
FIG. 1 is a perspective view showing a facial compact having a storage space in which a cover member is opened and a plate member is withdrawn, according to a first embodiment of the present invention.

A facial compact having a storage space according to a first embodiment of the present invention will be described below with reference to FIGS. 1 through 3.

A facial compact includes a receptacle member 10 in the form of a thin rectangular parallelepiped, and a cover member 20 hinged with the receptacle member 10. The receptacle member 10 is provided with a large rectangular recess 11 at a substantially upper surface thereof. Cosmetic material 12, such as cosmetic powder or powder puff, is filled into the recess 11. The receptacle member is also provided at a front end portion of the upper surface thereof with a small rectangular recess 13. A first engaging projection 14 extends rearwardly from a front wall of the recess 13. Further, the receptacle member 10 has formed at a central portion of a rear end thereof a notch 15. On the other hand, the cover member 20 has a rear end portion which is inserted in the notch 15 of the receptacle member 10 and rotatably supported by the receptacle member 10, whereby the cover member 20 is connected to the receptacle member 10 so that the cover member 20 can be opened or closed relative to the receptacle member 10.

That is, the cover member 20 has almost the same thin rectangular parallelepedic shape as does the receptacle member 10. The cover member 20 is integrally formed at a central portion of a rear end of a lower surface thereof with a block portion 21 in the form of a rectangular parallelepiped. The block portion 21 has a shape corresponding to the notch 15 and is fitted within the notch 15, and a pin 17 is provided between the receptacle member 10 and the block portion 21. Consequently, the cover member 20 is rotatably supported by the receptacle member 10.

In this embodiment, the cover member 20 is formed into a box-like shape having a large recess 42 which is open downwardly. A plate member 30 is slidable in front and rear directions relative to the cover member 20 so that the plate member 30 may be positioned to recess 42. To be more specific, guide grooves 22 are formed at opposite inner walls **20*a*, of the cover member 20 in such a manner that the guide grooves 22 are positioned adjacent to the lower edges of the inner side walls of cover member 20 and extend in a front and rear directions. The guide grooves 22 are open at the front end of the cover member 20 and terminate at positions in the vicinity of the rear end of the cover member 20. The plate member 30 has at opposite sides thereof integral projecting guide rails 31. The projecting guide rails 31 extend along the side walls of the plate member 30 so as to correspond to the guide grooves 22. Since the projecting guide rails 31 are slidably fitted in the guide grooves 22, the plate member 30 can stably move in front and rear directions relative to the cover member 20. The projecting guide rails 31 have at rear portions thereof still more widely outwardly projecting portions (not shown) to prevent the plate member 30 from falling off from the cover member 20**.

The plate member 30 has a mirror 35 attached thereto and a projection 36 extending downwardly from the central front end portion thereof. The projection 36 is provided with a second engaging projection 37 which extends outwardly from the front end face of the projection 36. When the cover member 20 is closed, the projection 36 is inserted into the recess 13 of the receptacle member 10 and the second engaging projection 37 is engaged with the first engaging projection 14, thereby maintaining the cover member 20 in a closed position.

Further, a plate spring 28 having an arcuate shape is provided on a central portion of a rear inner wall 20*b* of the cover member 20. The plate spring 28 can be brought into contact with a rear wall of the plate member 30, thereby urging the plate member 30 in a forward direction and thus maintaining the cover member 20 in a closed position.

Furthermore, in this embodiment of the present invention, a desirable space is defined between the upper surface of the plate member 30 and the inner surface of the cover member 20. This space constitutes the storage space 43 for accommodating cosmetic related articles such as cleansing papers or pads 40*a*.

Next, usage of the facial compact will be described below.

Figure 2:
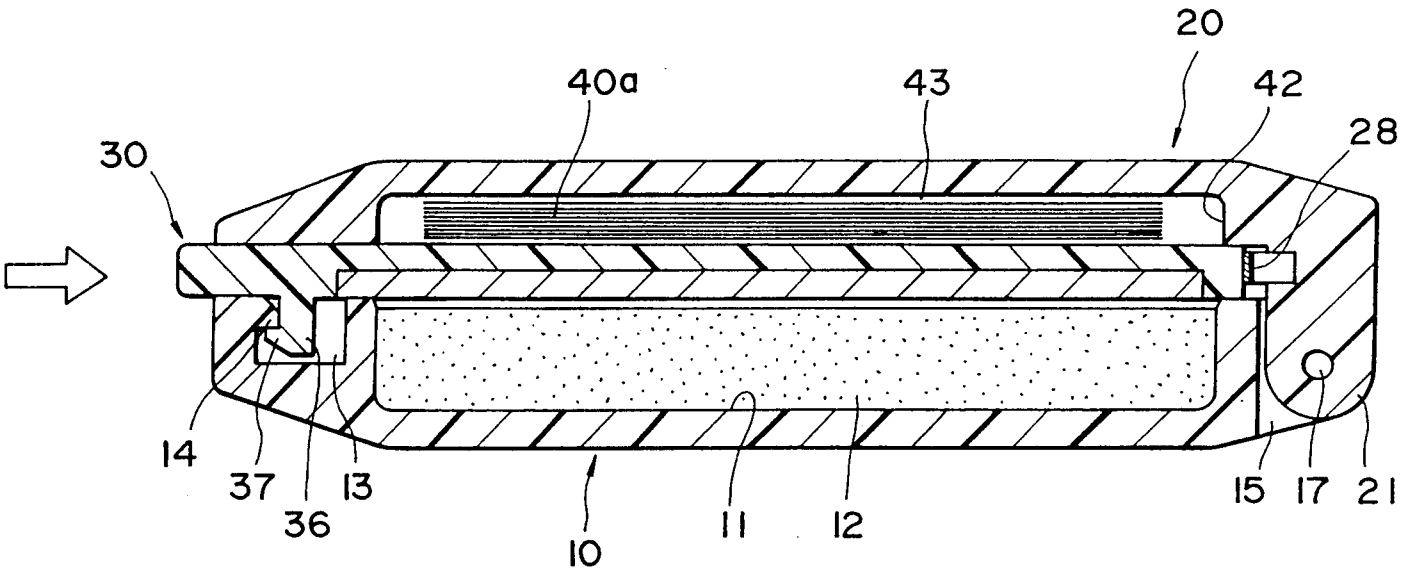
FIG. 2 is a cross-sectional view showing the facial compact having a storage space in which the cover member is closed, according to the first embodiment of the present invention.

Assuming now that the cover member 20 is closed over the receptacle member 10 as shown in FIG. 2, when the cover member 20 is opened, the front end face of the plate member 30 is pressed toward the rear direction. At this time, the plate member 30 is moved rearwardly with guide rails 31 sliding along the guide grooves 22. At the same time, the projection 36 provided on the plate member 30 is moved rearwardly, and the second engaging projection 37 provided on the projection 36 is moved away from the first engaging projection 14, thereby releasing engagement between the first and second engaging projections 14, 37. Thereafter, the front end of the cover member 20 is rotated upwardly about the pin 17 and the cover member 20 thus is opened relative to the receptacle member 10.

Further, when the plate member 30 is moved rearwardly, the rear wall of the plate member 30 presses the plate spring 28, thereby compressively deforming the plate spring 28. Accordingly, after the cover member 20 is opened, when the plate member 30 is released from the urging force of the plate spring 28, the plate member 30 will have been moved forward due to the resilience of the plate spring 28, such that the plate member 30 is at an original position, with the storage space 43 defined inside the cover member 20 covered by the plate member 30, as shown in FIG. 3.

As a result, even if the cover member 20 is opened, the cleansing papers 40*a* accommodated in the storage space 43 are not visible from the outside and are prevented from falling from space 43. Therefore, the facial compact can be normally used while watching the mirror 35.

On the other hand, when touching up one's makeup, a cleansing paper 40*a* maybe used to soak up oil on the made-up face so that additional makeup can be easily applied. In this case, after opening the cover member 20, the plate member 30 is drawn out in a forward direction opposite to direction of movement for the operation of opening the cover member 20. At this time, the plate member 30 is drawn out while being guided by the guide grooves 22, thereby exposing the storage space 43. As a consequence, cleansing papers 40*a* easily can be removed from the storage space 43. Thereafter the remaining cleansing papers 40*a* are accommodated again in the storage space 43 and the plate member 30 is closed, and the facial compact again is ready for use as a usual facial compact.

In this embodiment, the first and second engaging projections are provided at the front end portion of the facial compact, however they may be provided at lateral side portions of the facial compact. In such case, when the plate member is caused to slide in the opening direction, spaced opposite engaging projections are disengaged.

Further, in this embodiment, the plate member is slidable in front and rear directions, however it may by slidable in opposite lateral directions. That is, both the sliding direction of the plate member and disengaging direction of the engaging projections may be arranged in any direction. In short, it is sufficient to position the engaging projections so as to be disengaged from engagement by sliding the plate member.

Further, in this embodiment, the receptacle member and the cover member are connected with each other through the pin joint so that the cover member can be opened or closed relative to the receptacle member. However, they may be connected with each other through a hinged joint or by a flexible sheet material. Further, the receptacle member and the cover member may be formed integrally without any joint.

According to the first embodiment of the present invention, the following effects are attainable.

(1) Since the plate member is slidably provided at a lower side of the cover member and the two engaging projections of the plate member and the receptacle member are disengaged from each other by pushing the plate member, the plate member, corresponding to a conventional push piece, can be relatively large, thereby improving the operation of opening the cover member.

(2) Since the plate member is relatively large, the plate member can be slidably attached to the cover member by easy assembly.

(3) Since between the plate member and the cover member there is provided a space which constitutes a storage space, cosmetic related articles such as cleansing papers can be stored in such storage space. Therefore, though the conventional cover member has only has the additional function of supporting a mirror, the cover member according to the present invention can be effectively utilized for an additional functional aspect. As a result, cosmetic related articles such as cleansing papers can be stored in the storage space and carried together with cosmetics, thus eliminating the former inconveniences of carrying such articles separately and removing them separately from a handbag or the like.

(4) Since the plate member functions both as means for opening the cover member and means for covering the storage space, the overall thickness of the facial compact does not become excessive in spite of the provision of the storage space.

A second embodiment of the present invention will be described below with reference to FIGS. 4 and 5.

Figure 3:
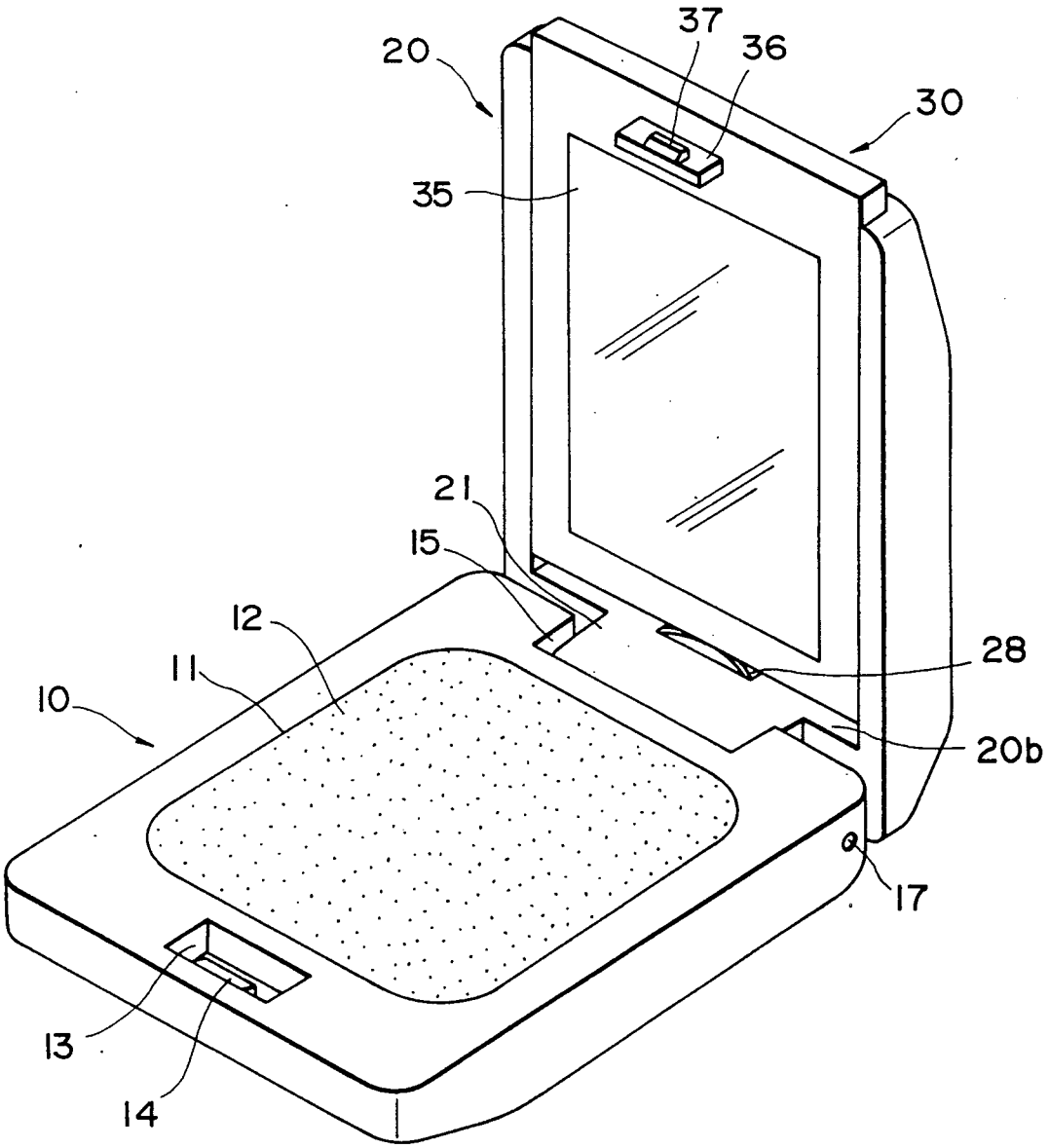
FIG. 3 is a perspective view showing the facial compact having a storage space in a normal state of usage in which the cover member is opened, according to the first embodiment of the present invention.
Figure 4:
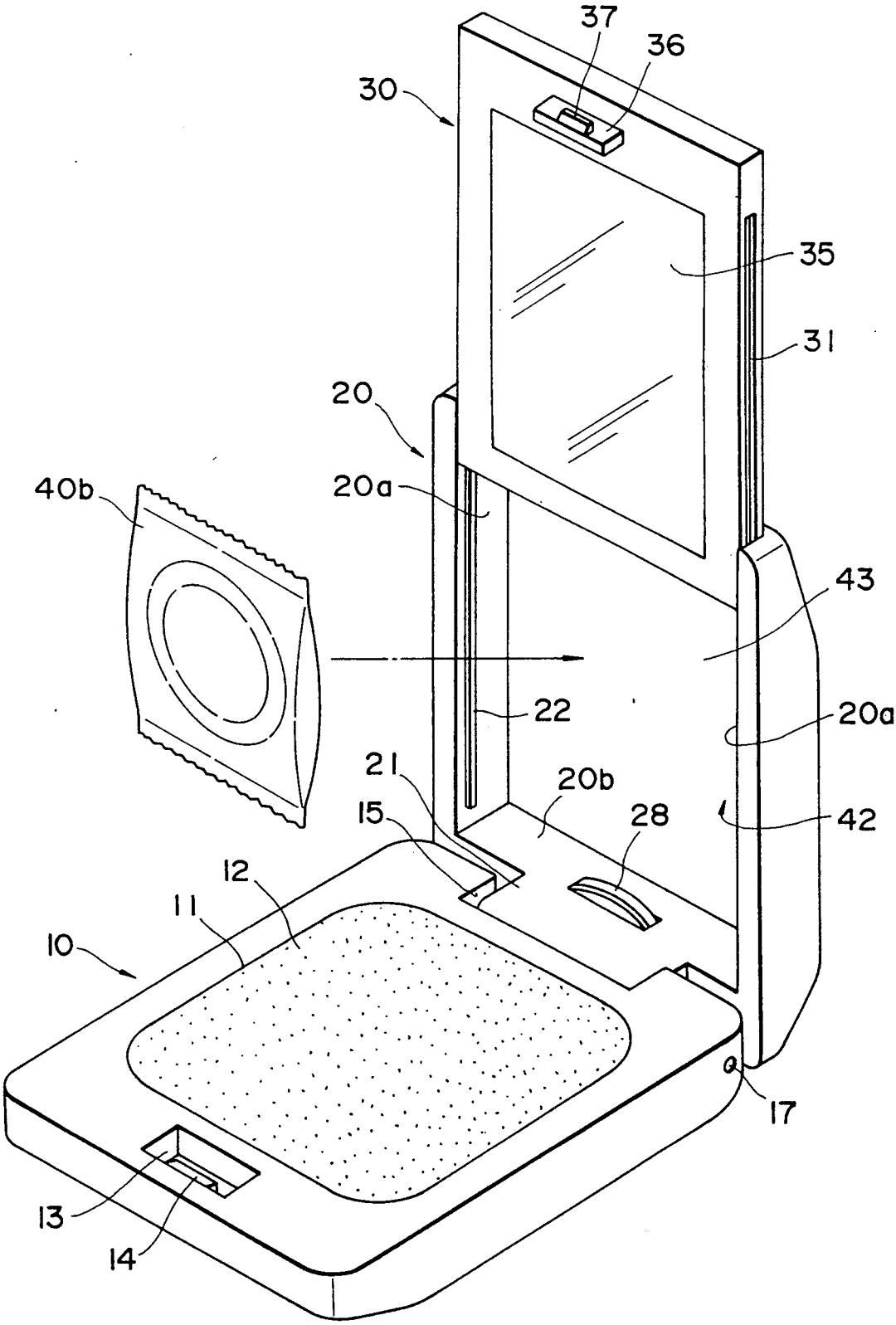
FIG. 4 is a perspective view showing a facial compact having a storage space in which a cover member is opened and a plate member is withdrawn, according to a second embodiment of the present invention.
Figure 5:
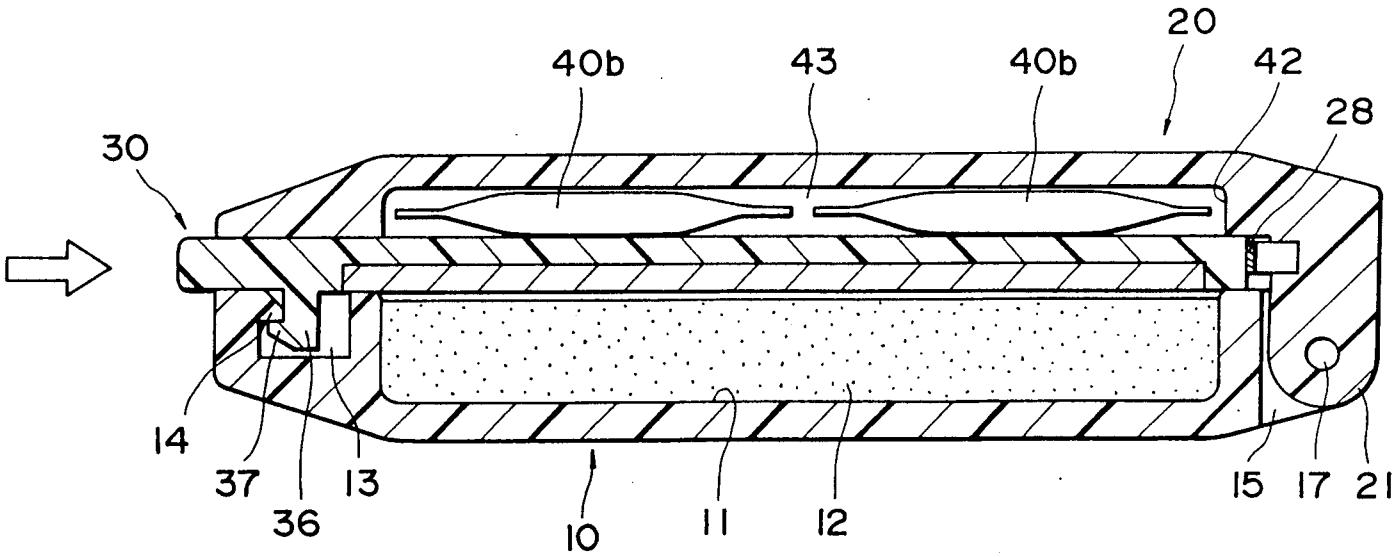
FIG. 5 is a cross-sectional view showing the facial compact having a storage space in which the cover member is closed, according to the second embodiment of the present invention.

The embodiment shown in FIGS. 4 and 5 has the same structure and function as that of the embodiment shown in FIGS. 1 through 3. In this embodiment, contraceptives 40*b* such as a condom or a pill are accommodated in the storage space 43.

In this embodiment, even if the cover member 20 is opened, the contraceptives 40*b* accommodated in the storage space 43 are not visible from outside and are prevented from falling out. Therefore, during normal use of the facial compact, there is no fear that other people will became aware of the user carrying the contraceptives 40*b*. In the conventional facial compact, since the cover member has only the additional function of supporting a mirror, one would not think that contraceptives 40*b* are accommodated inside the cover member 20.

On the other hand, when using the contraceptives 40*b*, after opening the cover member 20, the plate member 30 is drawn out in a forward direction opposite to the direction of movement for opening the cover member 20. At this time, the plate member 30 is smoothly drawn out while being guided by the guide grooves 22, the lower portion of the cover member 20 is opened to thus expose the storage space 43. As a consequence, the contraceptives 40*b* easily can be removed from the storage space 43. Thereafter the plate member 30 is closed, and the facial compact is used as a normal facial compact.

According to the second embodiment of the present invention, the following effects are attainable.

(1) Since the plate member is slidably provided at a lower side of the cover member and between the plate member and the cover member there is provided a space which constitutes a storage space for accommodating contraceptives, the storage space defined inside the cover member is normally covered by the plate member. Therefore, the contraceptives accommodated in the storage space are not visible during normal use of the facial compact. Accordingly, when makeup is applied, the facial compact can be used as a normal facial compact by opening the cover member, and when using the contraceptive, the contraceptive accommodated in the storage space can be removed by drawing out the plate member and thus opening the storage space.

(2) In a conventional facial compact, since the cover member has only has the additional function of supporting a mirror, one would not think that contraceptives 40*b* are accommodated inside the cover member 20. Further, since usually a facial compact itself is carried, the facial compact according to the present invention can be freely and naturally carried without others knowing of its contents.

Next, a modification of the second embodiment of the present invention will be described with reference to FIG. 6.

Figure 6:
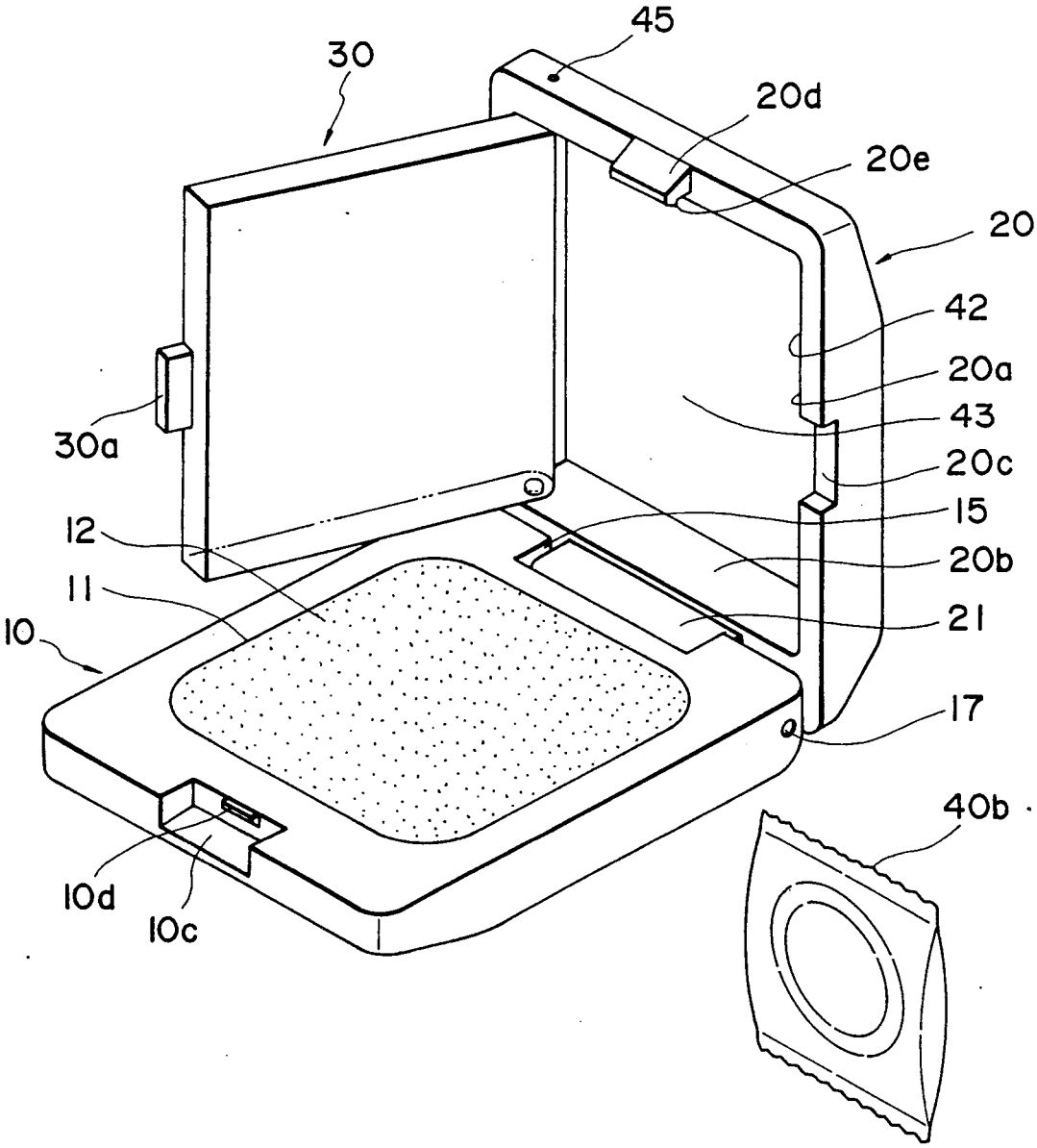
FIG. 6 is a perspective view showing a facial compact having a storage space in which a cover member is opened and a plate member is withdrawn, according to a modified embodiment of the present invention.

Those parts shown in FIG. 6 which is structurally and functionally identical to those shown in FIGS. 4 and 5 are denoted at identical reference numerals, and will not be described in detail.

In this modified embodiment, a pin 45 is provided between the cover member 20 and the plate member 30 as shown in FIG. 6, such that the plate member 30 is rotatably supported on the cover member 20 through the pin 45. The cover member 20 has a notch 20*c* at one side edge thereof, while the plate member 30 has a projection 30*a* at one side end face thereof. The projection 30*a* is fitted within the notch 20*c* when the plate member 30 is closed, and the storage space 43 which can store the contraceptives 40*b* is covered by the plate member 30.

Further, in this embodiment, the cover member 20 has a projection 20*d* extending downwardly from a lower surface thereof and a second engaging projection 20*e* projecting rearwardly from the projection 20*d*. On the other hand, the receptacle member 10 has a first engaging projection 10*d* formed in a recess 10*c* which is provided at front end of the receptacle member 10. The second engaging projection 20*e* is engageable with the first engaging projection 10*d*. The cover member 20 is maintained in a closed position relative to the receptacle member 10 by snap engagement between the first and second engaging projections 10*d*, 20*e*. When opening the cover member 10 from the closed state, the front end of the cover member 10 is urged upwardly, resulting in upward displacement of the second engaging projection 20*e* climbing over the first engaging projection 10*d*, so that the second engaging projection 20*e* is disengaged from the first engaging projection 10*d* and the cover member 20 is opened relative to the receptacle member 10. After opening the cover member 20, the plate member 30 is rotated about the pin 45 to thus expose the storage space 43 while touching and holding the projection 30*a*.

In the second embodiment and the modified embodiment of the second embodiment, the contraceptives are accommodated in the storage space and secretly carried together with cosmetics. However, any other articles can be accommodated in the storage space and secretly carried together with cosmetics.

Although certain preferred embodiments have been shown and described, it should be understood that many changes and modifications may be made thereto without departing from the scope of the appended claims.

What is claimed is:

1. A facial compact having a storage space and comprising:

a receptacle member having a space for accommodating cosmetic material;

a cover member connected to said receptacle member at respective rear ends thereof for closing and opening said receptacle member;

a recess formed in a lower surface of said cover member to define therein a storage space;

a plate member slidably mounted on a lower portion of said cover member and adapted to close said storage space, said plate member having a front end portion projecting forwardly from a front edge of said cover member when said plate member is in a projected position;

means, mounted between said plate member and said cover member, for urging said plate member to said projected position;

first engaging means provided on said receptacle member;

second engaging means provided on said plate member for engagement with said first engaging means;

said first and second engaging means being disengagable from each other upon inward movement of said plate member against the force of said urging means, thereby opening said cover member; and said storage space being opened upon forward movement of said plate member relative to said cover member when said cover member is in the open position thereof.

2. A facial compact as claimed in claim 1, further comprising a mirror attached to said plate member.

3. A facial compact as claimed in claim 1, further comprising a second recess formed in a front marginal portion of said receptacle member, and wherein said first engaging means comprises an engaging projection extending rearwardly from a front wall defining said second recess.

4. A facial compact as claimed in claim 3, wherein said second engaging means comprises a main projection extending downwardly from a lower surface of said plate member and an engaging protrusion extending forwardly from a front surface of said main projection.

5. A facial compact as claimed in claim 1, wherein said storage space is adapted to accommodate cosmetic related articles.

6. A facial compact as claimed in claim 1, wherein said storage space is adapted to accommodate a contraceptive.

7. A facial compact as claimed in claim 1, wherein said plate member includes means for preventing said plate member from falling off from said cover member when said storage space is closed.

8. A facial compact as claimed in claim 1, wherein said urging means comprises a spring abutting a rear end of said plate member and urging said plate member forwardly.

* * * * *